US006730139B2

(12) United States Patent
Crawford et al.

(10) Patent No.: US 6,730,139 B2
(45) Date of Patent: May 4, 2004

(54) HALOGENATED HYDROCARBON CONTAINING FUEL SUPPLEMENT AND/OR ADDITIVE

(76) Inventors: Stephen R. Crawford, P.O. Box 747, Sanger, CA (US) 93657; James C. Crawford, P.O. Box 747, Sanger, CA (US) 93657

( * ) Notice: Subject to any disclaimer, the term of this patent is extended or adjusted under 35 U.S.C. 154(b) by 190 days.

(21) Appl. No.: 10/094,405

(22) Filed: Mar. 7, 2002

(65) Prior Publication Data

US 2003/0167682 A1 Sep. 11, 2003

(51) Int. Cl.[7] ..... C10L 1/20; C10L 1/30

(52) U.S. Cl. ..... 44/308; 44/361; 44/398; 44/456

(58) Field of Search ..... 44/308, 361, 398, 44/456

(56) References Cited

U.S. PATENT DOCUMENTS

| | | | | | |
|---|---|---|---|---|---|
| 4,451,266 | A | * | 5/1984 | Barclay et al. | 44/308 |
| 4,504,280 | A | * | 3/1985 | Efner et al. | 44/386 |
| 4,634,452 | A | * | 1/1987 | Secor | 44/306 |
| 4,844,825 | A | * | 7/1989 | Sloan | 508/416 |
| 5,186,722 | A | * | 2/1993 | Cantrell et al. | 44/605 |

* cited by examiner

*Primary Examiner*—Margaret B. Medley
(74) *Attorney, Agent, or Firm*—Steven J. Adamson

(57) ABSTRACT

A fuel rendering composition, an alternative supplemental fuel and a universal fuel treatment. Halogenated hydrocarbon(s) and solvent(s), particularly terpenoid containing solvent(s), are combined to form a composition that when mixed with vegetable oil, crude or refined, renders that oil suitable for use in a diesel engine. Various hydrocarbons, solvents and related compounds are disclosed. Providing a metal-organic compound such as a cyclopentadienyl compound with a halogenated hydrocarbon and solvent at appropriate rates produces a universal fuel treatment.

20 Claims, No Drawings

HALOGENATED HYDROCARBON CONTAINING FUEL SUPPLEMENT AND/OR ADDITIVE

FIELD OF THE INVENTION

The present invention relates to the creation of vegetable oil based alternative fuels for use with internal combustion engines, particularly diesel engines. The present invention includes the use of halogenated hydro-carbon(s) and solvent (s) to render vegetable oils into an effective alternative fuel. The present invention also includes the combination of halogenated hydro-carbons and solvents with a combustion catalyst as a fuel treatment for all fuels.

BACKGROUND OF THE INVENTION

Prior art for the present invention may include certain uses of halogenated hydrocarbons in fuel supplements, additives and treatments.

U.S. Pat. No. 4,451,266, issued to Barclay et al for an Additive for Improving Performance of Liquid Hydrocarbon Fuels, discloses a fuel comprised of a mixture of low molecular weight alcohol, an aliphatic ester, an aromatic hydrocarbon, a halogenated alkene, a hydroxy unsaturated vegetable oil and an aliphatic hydrocarbon. The additive is intended to improve fuel efficiency and be clearer burning, i.e., reduce engine deposits. This invention is limited to a fuel additive and does not render alternative fuel material suitable for use in an internal combustion engine. This product is also disadvantageous, amongst other reasons, in that a large number of ingredients are required. Obtaining, measuring and mixing these ingredients is involved and reasonably expensive. In addition, supplemental ingredients or process steps, e.g., shaking before use, are often required to assure that the various ingredients do not separate or settle out.

U.S. Pat. No. 4,844,825, issued to Sloan for an Extreme Pressure Additive for Use in Metal Lubrication, discloses the mixing of a substantial portion of chlorinated paraffins (a halogenated hydrocarbon) with a smaller portion of an alkaline earth metal sulfonate, such as calcium or barium sulfonate, and preferably a base mineral oil and solvent. This additive is disadvantageously limited to use in motor oil to enhance lubrication and is not applicable to fuel or to rendering an alternative fuel suitable for use in an internal combustion engine. This additive is also disadvantageous in that the solvents are aromatic solvents (benzene, toluene and xylene) which are known toxins and carcinogens.

Prior efforts by the inventor herein include development of an oil additive containing a halogentated hydrocarbon, epoxidized soybean oil and a corrosion inhibitor. This oil additive increases the lubricity of engine oil resulting in increased engine life or longer intervals between oil changes. Prior efforts also include development of a diesel fuel additive containing refined canola oil and d-limonene, a commercially known and available essential oil solvent from citrus. This additive is intended to increase lubrication and reduce deposits in the fuel supply pathway. The oil provides lubrication while the solvent reduces coagulation of certain molecules in the oil. Neither of these additives render an alternative fuel suitable for combustion in an internal combustion engine.

With respect to alternative fuels, a number of factors, including the increased price of petroleum oil, uncertainties in its supply, depressed agricultural markets and a desire for renewable fuel sources, are driving the development of and demand for alternative fuels. Corn, soybean and other vegetable oils have at times been considered as fuels, but for various reasons their development in this capacity has been slow and limited. Some entities are currently attempting to use methyl ester to remove sugar molecules from these vegetable oils to achieve a less engine fouling fuel. The extra process steps are disadvantageously involved and costly.

The present invention also includes a universal engine fuel treatment. While several fuel treatments are known, these prior art fuel treatments are generally highly toxic and flammable. A need exists for an efficacious fuel treatment, for any hydro-carbon containing liquid fuel, that is less toxic and/or flammable.

SUMMARY OF THE INVENTION

Accordingly, the present invention includes a composition for rendering vegetable oil useful and suitable as a fuel, particularly in combination with diesel fuel. In one embodiment, this composition includes a halogenated hydrocarbon (HHC) combined with a solvent such as a terpenoid containing solvent. In one preferred embodiment, the combination ratio of these components is in the range of approximately 2:1 to 20:1 (HHC:solvent) and more preferably between 4:1 to 10:1, and further more preferably about 6:1 (by weight or volume). The ratio may vary widely with the caveat that too much solvent may destroy seals, gaskets and other engine components.

The HHC may be any halogenated oil. In a preferred embodiment it is chlorinated oil. In a more preferred embodiment it is chlorinated olefin. The solvent may be, but is not limited to, any solvent from the large array of terpenoid containing substances or similar substances. These solvents are generally renewable, non-toxic and environmentally benign. In a preferred embodiment, the solvent is from the group including citrus distillates and like substances. These substances are food grade and tend to generate pleasant fragrances. Note that the solvent may be petroleum derived, despite the mentioned disadvantages.

The present invention also includes combining an HHC and solvent with ferrocene (dicyclopentadienyl iron) or a like material (metal-organic compound) to achieve a fuel treatment applicable to all liquid hydrocarbon fuels.

DETAILED DESCRIPTION

The present invention includes several "product types" and these product types include a fuel rendering composition, an alternative supplemental fuel, and a fuel that includes the fuel rendering composition and/or the alternative supplemental fuel. The present invention includes several embodiments of each of these products types.

Fuel Rendering Composition

The fuel rendering composition (FRC) includes a halogenated hydrocarbon (HHC) and a solvent. The HHC provides several functions including, but not limited to, preventing injector nozzles from clogging and maintaining an even spray pattern. The solvent provides several functions including, but not limited to, preventing or reducing carbon buildup in fuel delivery systems.

In one embodiment, the fuel rendering composition includes chlorinated olefin as the HHC, d-limonene as the solvent and epoxidized soybean oil (ESO). The ESO includes a double bond to oxygen that can break to form a bond with a free chlorine or other halogen atom, including radicals. The HHC and ESO are mixed to form a solution that is approximately 99% HHC and 1% ESO by weight, though other mixing percentages are within the present invention. The HHC with ESO is then combined in a ratio of approximately 6:1 with d-limonene. Note that while 6:1 (HHC:solvent) has demonstrable benefits, the present invention is not limited to this ratio. The ratio may vary from 4–10:1 to 2–20:1 or may extend beyond this latter range. One caveat is that as the amount of solvent increases, the opportunity for solvent induced damage of seals, gaskets and related engine sealing parts increases.

In another embodiment of a FRC in accordance with the present invention, the HHC is any suitable HHC including, but not limited to, such compounds as chlorinated or brominated oils. There is considerable variety in the hydrocarbon component, particularly given the large number of hydrocarbons known in the chemical arts. Representative examples include paraffin, vegetable oil and other oils. The halogen is more limited, as specified in Column VIIA of the Periodic Table.

While some of these compounds may be viewed as having toxic or other disadvantageous properties, (for example, flourinated HC may react with aluminum parts) they could be suitable as an HHC for purposes of the present invention if techniques are developed to mitigate their toxicity or other disadvantageous aspects.

In another embodiment of a FRC in accordance with the present invention, the solvent is preferably any suitable solvent that is naturally occurring, non-fossil fuel based and non-toxic. These solvents include terpenoid containing solvents. The solvent may be an essential oil solvent including, but not limited to, a solvent derived from a pine, citrus and/or herbaceous plant (e.g., mint, lavander, etc.). The solvent may be a citrus or other plant distillate. These substances are advantageous in that they are food-grade. The solvent may also include petroleum distillates such as xylene, benzene, toluene, gasoline, napth A, etc., though these compounds are less preferred due to their toxicity. It should be recognized that both the HHC and solvent components can vary without departing from the present invention.

The preferred ratios of HHC to solvent may vary as the HHC and/or solvent components vary. This variance is expected to be consistent with the known chemical properties of the selected ingredients and follow general procedures and principles known in the chemical arts.

Inclusion of ESO is preferred, and this substance functions with other HHCs. In addition, other compounds that serve the same or a related function to ESO may be utilized. These include other epoxidized vegetable oils and other preferably non-toxic substances that provide non-fully saturated bonds that are capable of bonding to a halogen.

Alternative Supplemental Fuel

The FRC is then mixed with vegetable oil to create a fuel substance that can be added to diesel fuel and used, preferably in combination with the diesel fuel, to effectively and efficiently run a diesel engine. Using an embodiment of the FRC discussed above that includes approximately 6:1 HHC:solvent, the FRC is added at approximately 1:320 by volume to vegetable oil to produce an alternative supplemental fuel (ASF). The vegetable oil may be crude or refined corn, soybean, sunflower, rapeseed (canola), safflower, peanut, palm, cottonseed or other vegetable or nut oil. In one embodiment, the vegetable oil is soybean oil.

Mixing at the approximately 1:320 ratio (and mixing again with diesel fuel, discussed below) creates a fuel that allows vegetable oils, crude or refined, to be run in a diesel engine without modification of the engine. It also prevents carbon buildup in the injector nozzles.

It should be recognized that while a preferred ratio is between 1:100–1000 (FRC:vegetable oil) and more preferably between 1:200–500, the present invention is not limited to these ratios and generally includes a mixing of any amount of a fuel rendering composition with a vegetable oil to be used as a fuel. It should also be recognized that the ratio of approximately 1:320 is reflective, at least in part, of a desire to provide approximately 1000 ppm of HHC in the ASF for a 30/70 blend of ASF with diesel. The 1000 ppm value preferably varies by approximately +/−500 ppm.

Diesel and Vegetable Oil Fuel

The ASF is preferably mixed with diesel fuel to create a fuel that is effective and efficient for a diesel engine. The mixed fuel is preferably between about 10–60% ASF and more preferably between about 20–50% ASF. Within this 20–50% range, optimum mix percentage may be fuel temperature dependent. When fuel temperature descends below 40 degrees F., the percentage of ASF preferably descends as well. About 40% ASF appears to perform well for fuel temperatures of about 40 degrees F. and above. Reducing to 30 to 20% ASF, etc., may be desirable for fuel temperatures of about 30 and 20 degrees F., respectively, etc., with further reduction to approximately 10% ASF for temperatures down to around minus 6 degrees F.

Note that a blend of approximately 10 to 20% ASF, etc., may be used for temperatures below 0 degrees F., depending on the use of other additives such as kerosene or gasoline to depress cloud point. It should be further noted that the use of unrefined vegetable oil helps reduce temperature limitations.

As ASF percentages increase above 50 and 60%, loss in performance may be observed because vegetable oil has different chemical and physical characteristics than petroleum diesel fuel.

It should be recognized that ASF also functions with diesel-ethanol fuel blends and the like.

EXAMPLE I

Torque and HP

FRC of 6:1 chlorinated olefin to d-limonene (with ESO as noted above) mixed with soybean oil, then mixed 50/50 with number 2 diesel fuel. This blend has an API gravity (60 degrees F.) of 30.0 and sulfur percentage of 0.3. Analysis of this blend using a John Deere 4450 tractor operating at 1001 RPM yielded the following.

| | |
|---|---|
| Control (no. 2 diesel alone) | |
| Torque (ft. lb.) | 676 |
| Horsepower | 128 |
| 10% ASF Blend | |
| Torque (ft. lb.) | 708 |
| Horsepower | 134 |
| 20% ASF Blend | |
| Torque (ft. lb.) | 707 |
| Horsepower | 135 |
| 40% ASF Blend | |
| Torque (ft. lb.) | 686 |
| Horsepower | 134 |

Results indicated that vegetable oil could be used as a significant portion of the fuel without compromising performance or requiring engine modifications.

EXAMPLE II

MPG

Several trials were conducted to assess performance of fuel blend when used by over-the-road trucks. One trial reported a 10% gain in horsepower and 9% gain in MPG. Another trial using a 20% ASF blend reported a 7.4% increase in MPG and a decrease in fuel used by hour of 8.9%.

In yet another trial, removal and inspection of fuel injector nozzles in a Caterpillar engine installed in a truck showed no additional increase of carbon deposits after more than 10,000 miles of operation using a 25% ASF blend.

EXAMPLE III

Emissions

Trials were conducted via Pennsylvania State University to analyze emissions from a diesel and vegetable oil fuel mix in accordance with the present invention. Dynamometer tests were conducted with both 25% ASF and number 2 diesel as the control.

Three of the four trial modes showed a reduction in carbon monoxide and carbon dioxide using the 25% ASF blend. Two of four trials showed a reduction a nitric oxide against the control. Exhaust temperatures were lower with the ASF blend on three of four trials suggesting longer engine wear.

Other trials were conducted in California using 33% ASF blend and number 2 (California) diesel without additives. A 4-cylinder Ford industrial engine driving an air compressor was utilized for this test. Results showed a reduction of $NO_x$ by more than 4%.

An additional analysis was performed on a 50% ASF blend. The average flashpoint was 132 degrees F., higher than the 125 degree F. flashpoint of number 2 diesel. The fuel was also classified as low sulfur, obtaining a reading of 0.015%, where 0.05% is the maximum level allowed for this classification.

Universal Fuel Treatment

In addition to the embodiments described above, the present invention also includes a universal fuel treatment (UFT) that functions for a wide range of fuels including, but not limited to, petroleum based fuels (kerosene, gasoline, diesel, and fuel oil, etc.), vegetable oil based fuels and other hydro-carbon containing liquid fuels. The UFT provides more complete combustion yielding cleaner exhaust, high-temperature upper cylinder lubrication, less carbon buildup and longer catalytic converter life, amongst other benefits.

In one embodiment a UFT in accordance with the present invention includes a HHC, a solvent and ferrocene. The HHC may include ESO as discussed above. Ferrocene is a metal-organic substance often provided as a crystal or powder that functions as a catalyst to promote more complete combustion. In this one embodiment, the UFT includes approximately 65% of a HHC such as chlorinated olefin, approximately 31.6% of a solvent such as Valencia peel oil solvent (that is food-grade and reduces component separation) and approximately 3.4% ferrocene, by weight. These percentages provide a composition of 60 ppm ferrocene when mixed in appropriate proportions with fuel. This value is preferred for diesel fuel, and 2-cycle engine fuels, etc., while a lower ferrocene concentration, for example, 30 ppm is preferred for gasoline. The above percentage could be readily modified by one skilled in the art to accommodate varying the ppm of the metal-organic catalyst.

A preferred range of ferrocene is from approximately 10–240 ppm and a preferred range of HHC is from approximately 50–5000 ppm, though concentrations outside of these preferred ranges are still within the present invention. The preferred ratio range of HHC to solvent (using a more mild solvent such as Valencia peel oil as compared to a citrus distillate) is approximately 1–10:1.

With respect to alternative components, the HHC component may vary widely as discussed above. The solvent component may include any suitable terpenoid or terpene containing substance. This may include citrus oil or other oils or like substances, particularly those that help prevent separation and thus reduce or eliminate "shake before use" instructions. While a citrus distillate or other solvent substances as discussed above may be used as the solvent in the UFT, use of a distillate such as d-limonene or the like may result in component separation and thus require shaking before use, when stored prior to mixing with fuels.

With respect to the ferrocene component, similar metal-organic substances may be utilized. These preferably include metal-organic compounds using earth metals from the first row of the Periodic Table such as vanadium, chromium, manganese, iron, cobalt and nickel (though other suitable compounds may be used). Within this group of compounds are metallocenes that include cyclopentadienyl (CP) complexes and CP derivatives such as pentamethylcyclopentadienyl. CP ligands can stabilize metals in a variety of d-electron counts (as well as oxidation states other than 2+).

The CP derivatives tend to have desirable steric, electronic or spectroscopic properties. Their use may be preferable to CP. The pentamethylcyclopentadienyl ligand, C5Me5, is one of the best known of these and has the designation CP*. CP* is sterically more demanding than CP, allowing the isolation of CP* complexes for which the CP analogs are unknown or are kinetically unstable. In decamethylferrocene (CP*2Fe), for example, the methyl groups are electron donors, which results in more electron density at the metal than for the analogous CP complex. Electrochemical measurements indicate that CP* complexes are more easily oxidized than their CP analogs by approximately 0.5 V, suggesting that fuels would burn faster and cleaner.

Various industrial tests are known for detecting the constituent components discussed herein.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A fuel additive composition, comprising:

a halogenated hydrocarbon; and a terpenoid containing solvent.

2. The composition of claim 1, wherein said halogenated hydrocarbon and said solvent are provided in a ratio range of approximately 2–20:1.

3. The composition of claim 1, wherein said halogenated hydrocarbon and said solvent are provided in a ratio range of approximately 4–10:1.

4. The composition of claim 1, wherein said halogenated hydrocarbon includes at least one of a chlorinated hydrocarbon or a brominated hydrocarbon.

5. The composition of claim 1, wherein said halogenated hydrocarbon includes a chlorinated oil.

6. The composition of claim 1, wherein said solvent includes a plant derived solvent.

7. The composition of claim 1, wherein said solvent includes a citrus distillate.

8. The composition of claim 1, further comprising an epoxidized vegetable oil.

9. The composition of claim 1, further comprising a metal-organic compound.

10. The composition of claim 1, further comprising a cyclopentadienyl compound.

11. An alternative fuel composition, comprising:

a halogenated hydrocarbon;

a terpenoid containing solvent; and vegetable oil.

12. The composition of claim 11, wherein said vegetable oil is provided with said halogenated hydrocarbon and solvent at a ratio of greater than 100:1.

13. The composition of claim 12 wherein, said ratio is between 200–500:1.

14. The composition of claim 11, wherein said vegetable oil includes one or more of the following types of oil: corn, soybean, sunflower, rapeseed (canola), safflower, peanut, palm, cottonseed oil or nut oil.

15. The composition of claim 11, further comprising diesel fuel.

16. The composition of claim 15, wherein said diesel fuel is provided in a range of approximately 90–40%.

17. The composition of claim 11, wherein said halogenated hydrocarbon is a chlorinated oil.

18. A fuel additive composition, comprising:

a halogenated hydrocarbon; and a terpenoid solvent;

wherein the ratio of said halogenated hydrocarbon to said solvent is approximately 3:1 or greater.

19. A method of for producing an alternative fuel, comprising the steps of:

providing a halogenated hydrocarbon;

providing a terpenoid containing solvent; and mixing said halogenated hydrocarbon and solvent with vegetable oil.

20. The method of claim 19, further comprising the steps of mixing diesel fuel with said combination of halogenated hydrocarbons, solvent and vegetable oil, to provide a fuel suitable in an internal combustion engine.

* * * * *